US011148250B2

(12) United States Patent
Dutschke et al.

(10) Patent No.: US 11,148,250 B2
(45) Date of Patent: Oct. 19, 2021

(54) METHOD FOR DRESSING POLISHING PADS

(71) Applicant: Siltronic AG, Munich (DE)

(72) Inventors: Vladimir Dutschke, Lengefeld (DE); Torsten Olbrich, Dresden (DE); Leszek Mistur, Burghausen (DE); Markus Schnappauf, Zell am Moos (AT)

(73) Assignee: SILTRONIC AG, Munich (DE)

( * ) Notice: Subject to any disclaimer, the term of this patent is extended or adjusted under 35 U.S.C. 154(b) by 533 days.

(21) Appl. No.: 14/994,202

(22) Filed: Jan. 13, 2016

(65) Prior Publication Data

US 2016/0199964 A1 Jul. 14, 2016

(30) Foreign Application Priority Data

Jan. 14, 2015 (DE) ..... 10 2015 200 426.0
Oct. 15, 2015 (DE) ..... 10 2015 220 090.6

(51) Int. Cl.
*B24B 53/017* (2012.01)
*B24B 53/02* (2012.01)
(Continued)

(52) U.S. Cl.
CPC ..... *B24B 53/017* (2013.01); *B24B 49/18* (2013.01); *B24B 53/003* (2013.01); *B24B 53/02* (2013.01); *B24B 53/12* (2013.01)

(58) Field of Classification Search
CPC ..... B24B 7/17; B24B 37/022; B24B 37/08; B24B 53/00; B24B 53/003; B24B 53/013;
(Continued)

(56) References Cited

U.S. PATENT DOCUMENTS 3,662,498 A * 5/1972 Caspers ..... B24B 37/08 451/269
6,221,773 B1 * 4/2001 Yasui ..... B24B 7/228 257/E21.23

(Continued)

FOREIGN PATENT DOCUMENTS

CN 101277464 A 10/2008
DE 10007390 A1 10/2000

(Continued)

*Primary Examiner* — Eileen P Morgan
(74) *Attorney, Agent, or Firm* — Leydig, Voit & Mayer Ltd.

(57) ABSTRACT

A method dresses one polishing cloth or two polishing pads simultaneously, in which a polishing cloth has been applied to a polishing plate, with at least one dresser (4), which is equipped with at least one dressing element (8), this at least one dressing element (8) being in contact with the at least one polishing cloth (11, 12) to be dressed, wherein the at least one polishing plate (21, 22) is rotated with a relative rotational speed and the at least one dresser (4) is rotated with a relative rotational speed and at least two different combinations of directions of rotation of the two pairs of polishing plates (21, 22) and pin wheels (31, 32) are executed during the simultaneous dressing of two polishing pads (11, 12) or during the dressing of one polishing cloth (11) of the polishing plate (21) and of the at least one dresser (4).

18 Claims, 3 Drawing Sheets

(51) Int. Cl.
*B24B 53/12* (2006.01)
*B24B 49/18* (2006.01)
*B24B 53/00* (2006.01)

(58) Field of Classification Search
CPC ..... B24B 53/02; B24B 53/017; B24B 37/04; B24B 53/12; B24B 49/18
USPC ..... 451/56, 443
See application file for complete search history.

(56) References Cited

U.S. PATENT DOCUMENTS 6,364,752 B1 4/2002 Kimura et al.
6,910,947 B2 * 6/2005 Paik ..... B24B 49/18 451/21
7,040,956 B2 * 5/2006 Paik ..... H01L 22/20 451/5
7,169,030 B1 * 1/2007 Kulp ..... B24B 37/24 451/526
7,648,409 B1 * 1/2010 Horiguchi ..... B24B 53/017 451/41
8,579,679 B2 * 11/2013 Fukushima ..... B24B 37/08 451/283
9,011,209 B2 * 4/2015 Pietsch ..... B24B 37/08 451/262
9,221,149 B2 * 12/2015 Baumann ..... B24B 37/08
2002/0072300 A1 6/2002 Kimura et al.
2002/0197934 A1 * 12/2002 Paik ..... B24B 37/042 451/21
2003/0054650 A1 3/2003 Wenski et al.
2004/0023602 A1 * 2/2004 Moloney ..... B24B 53/017 451/56
2005/0208879 A1 * 9/2005 Paik ..... B24B 49/03 451/5
2009/0311948 A1 * 12/2009 Hashii ..... B24B 7/17 451/44
2011/0189505 A1 * 8/2011 Ono ..... B24B 37/12 428/846.9
2011/0312182 A1 * 12/2011 Borucki ..... B24B 37/042 438/693
2013/0059503 A1 * 3/2013 Yeh ..... B24B 53/053 451/56
2014/0099868 A1 * 4/2014 Sung ..... B24B 37/044 451/56
2014/0113532 A1 * 4/2014 Smith ..... B24B 53/017 451/443
2014/0308878 A1 10/2014 Baumann et al.
2015/0133036 A1 * 5/2015 Sung ..... B24B 53/017 451/56

FOREIGN PATENT DOCUMENTS

DE 69729590 T2 6/2005
JP 2004098264 A 4/2004
TW 201431647 A 8/2014
TW 201440135 A 10/2014

* cited by examiner

METHOD FOR DRESSING POLISHING PADS

CROSS-REFERENCE TO RELATED APPLICATIONS

Priority is claimed to German Patent Applications No. DE 10 2015 200 426.0, filed Jan. 14, 2015, and DE 10 2015 220 090.6 filed Oct. 15, 2015, the entire disclosure of each of which is hereby incorporated by reference herein.

FIELD

The present invention relates to a method for dressing polishing pads (cloths), in particular polishing pads for use in the polishing of semiconductor wafers.

BACKGROUND

For electronics, microelectronics and micro-electromechanics, semiconductor wafers that have to meet extreme requirements for global and local flatness, flatness on one side (nanotopology), roughness and cleanness are required as starting materials. Semiconductor wafers are slices of semiconductor materials such as single-element semiconductors (silicon, germanium), compound semiconductors (for example comprising one element from the third main group of the periodic table, such as aluminum, gallium or indium, and one element from the fifth main group of the periodic table, such as nitrogen, phosphorus or arsenic) or compounds thereof (for example SiI-xGex, 0<x<1).

Semiconductor wafers are produced by means of a large number of successive process steps, which can generally be divided into the following groups:

(a) producing a usually monocrystalline semiconductor rod;

(b) separating the rod into individual wafers;

(c) mechanical processing;

(d) chemical processing;

(e) chemo-mechanical processing;

(f) optionally additional production of layer structures.

Advantageous here in the production of semiconductor wafers for particularly demanding applications are procedures that comprise at least one processing method in which both sides of the semiconductor wafers are processed in a material-removing manner simultaneously in one processing step by means of two working faces, to be precise in such a way that the processing forces acting on the semiconductor wafer from the front side and the rear side during the removal of material substantially balance out, and no constraining forces are exerted on the semiconductor wafer by a guiding device, in other words the semiconductor wafer is processed in a "freely floating" manner.

Preferred here in the prior art are procedures in which both sides of at least three semiconductor wafers are processed in a material-removing manner simultaneously between two annular working disks, the semiconductor wafers being placed loosely into receiving openings of at least three externally toothed guiding cages (known as carrier plates), which are guided by means of a rolling device and the external toothing under pressure on cycloidal paths through the working gap formed between the working disks, so that they can thereby run completely around the center point of the double-sided processing device. Such methods that process both sides of a plurality of semiconductor wafers over the full surface area simultaneously in a material-removing manner with circulating carrier plates are double-sided lapping ("lapping"), double-sided polishing (DSP) and double-sided grinding with planetary kinematics ("planetary pad grinding", PPG). Of these, DSP and PPG especially are of particular significance. As a difference from lapping, in the case of DSP and PPG the working disks in each case additionally comprise a working layer, the mutually facing sides of which represent the working faces. PPG and DSP are known in the prior art and are briefly described below.

"Planetary pad grinding" (PPG) is a method from the group of mechanical processing steps that brings about a removal of material by means of grinding. In PPG, each working disk comprises a working layer, which contains bound abrasive material. The working layers take the form of structured grinding cloths, which are attached on the working disks adhesively, magnetically, by interlocking engagement (for example by means of hook-and-loop fastening) or by means of a vacuum. The working layers have sufficient adhesion on the working disk not to be displaced, deformed (formation of a bead) or become detached during the processing. They are, however, easily removable from the working disks by means of a peeling movement, and consequently quickly exchangeable, so that it is possible to change quickly between different types of grinding cloth for different applications without long set-up times. The abrasive material (abrasive) that is used in the grinding cloths is preferably diamond.

Double-sided polishing (DSP) is a method from the group of chemo-mechanical processing steps. DSP processing of silicon wafers is described for example in US 2003/054650 A1 and a device suitable for it is described in DE 100 07 390 A1. In this description, "chemo-mechanical polishing" is to be understood exclusively as meaning a removal of material by means of a mixed action, comprising chemical etching by means of an alkaline solution and mechanical erosion by means of loose grain dispersed in an aqueous medium, which is brought into contact with the semiconductor wafer by a polishing cloth, which does not contain any hard substances that come into contact with the semiconductor wafer, and so a removal of material from the semiconductor wafer is brought about under pressure and by relative movement. In the case of DSP, the working layers take the form of polishing pads, and these are attached on the working disks adhesively, magnetically, by interlocking engagement (for example by means of hook-and-loop fastening) or by means of a vacuum and in the case of DSP are also referred to as so-called polishing plates. In the case of chemo-mechanical polishing, the alkaline solution preferably has a pH of between 9 and 12, and the grain dispersed therein is preferably a colloid-dispersed silica sol with grain sizes of the sol particles of between 5 nm and several micrometers.

In the case of DSP, residual defects are removed by the preceding mechanical processing steps. The semiconductor wafers are planarized on both sides and the surface of the semiconductor wafers is prepared for further processing steps. In this case, a factor that is decisive for the quality of the processing in the case of DSP or other polishing methods is the dressing of the polishing pads. Dressing is understood as meaning a conditioning of the polishing pads in which the surface of the polishing pads that is contaminated and worn away by the polishing is cleaned and improved. For example, the asperities that are present on the surface, which serve for transporting the polishing agent and are worn away during the polishing, are intended to be restored thereby.

JP 2004-98264 A discloses for example a method for dressing polishing pads in which the polishing pads have been applied to the upper and lower polishing plates of a DSP device. The polishing plates in this case rotate in opposite directions and in each case counter to the direction of rotation that is used during the polishing. Furthermore, although it is mentioned that the method described there can also be used in the case of four-way DSP devices, this is not referred to any more specifically.

DE 697 29 590 T2 also discloses a method for dressing polishing pads. In the case of the method described there, a polishing cloth applied to a turntable is dressed by a dresser being moved on the polishing cloth. In this case, the dresser and the plate are rotated in the same direction. The rotational speeds of the polishing platen and the dresser are in this case variable and independent of one another.

However, the effect that is achieved by the known methods for dressing polishing pads does not usually last long and also does not produce a satisfactory effect for many polishing pads that are used.

It therefore continues to be desirable to provide a possible way of dressing polishing pads by which the polishing pads have the best possible polishing quality after the dressing and the effect of the dressing lasts as long as possible.

SUMMARY

An aspect of the invention provides a method for dressing one polishing cloth, or simultaneously dressing two polishing pads, each including a polishing cloth applied to a polishing plate, using at least one dresser including a dressing element, the dressing element being in contact with the polishing cloth to be dressed, the method comprising: rotating the at least one polishing plate with a first relative rotational speed; rotating the at least one dresser with a second relative rotational speed; and executing at least two different combinations of directions of rotation of (i) the polishing plates and pin wheels during a simultaneous dressing of the two polishing pads or during the dressing of the one polishing cloth of the polishing plate, and (ii) the at least one dresser.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
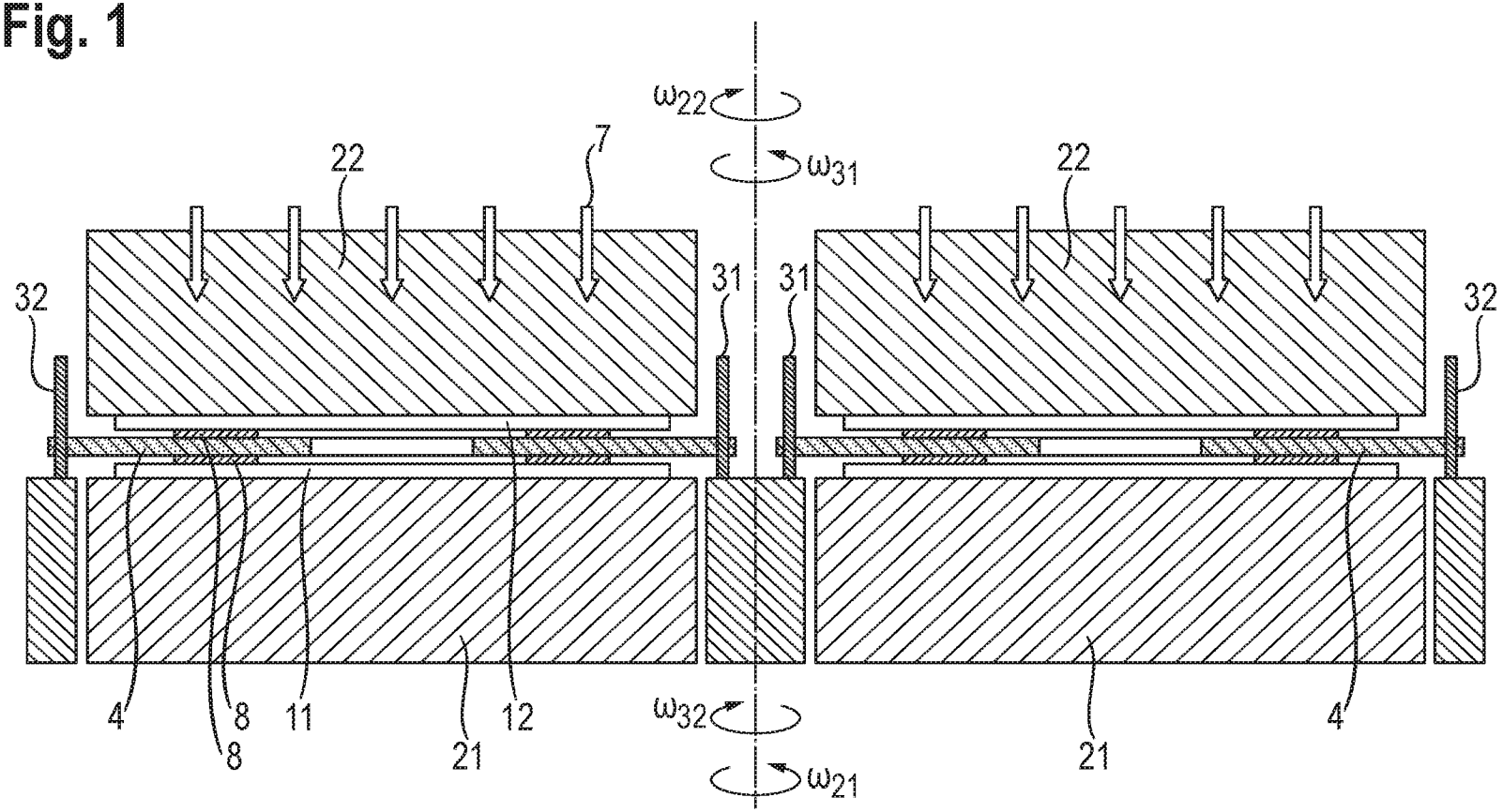
FIG. 1 shows schematically, in a cross sectional view, a device that can be used for carrying out a method according to the invention.

A method according to the invention serves for dressing polishing pads, in particular dressing foamed polishing pads for use in the polishing of semiconductor wafers. The method according to the invention may be used both for dressing an individual polishing cloth and for simultaneously dressing two polishing pads.

Semiconductor wafers are slices of semiconductor materials such as single-element semiconductors (silicon, germanium), compound semiconductors (for example comprising one element from the third main group of the periodic table, such as aluminum, gallium or indium, and one element from the fifth main group of the periodic table, such as nitrogen, phosphorus or arsenic) or compounds thereof (for example SiI-xGex, $0<x<1$).

When dressing an individual polishing cloth, a device for polishing one side of at least one semiconductor wafer, that is to say a one-sided polishing machine, is preferably used.

A method according to the invention is explained below on the basis of the example of the simultaneous dressing of two polishing pads, without restricting the scope of the invention to this embodiment. For the simultaneous dressing of two polishing pads, a device for simultaneously polishing the front side and the rear side of at least one wafer, that is to say a double-sided polishing machine, is preferably used. Used for this purpose are an upper polishing plate and a lower polishing plate and also at least two, and particularly preferably at least three to five, dressers, which are arranged between the upper polishing plate and the lower polishing plate and are moved by an inner gear wheel and an outer gear wheel.

A dresser is a carrier in form of a disk or ring equipped with dressing elements, which can be bounded or screwed or free movable placed in the carrier, on at least the side (front side or rear side or upper side or underside) that is facing the polishing cloth. Depending on the preferred embodiment, disk-shaped or annular dressers may be used. A combination, i.e. some disk-shaped dressers and some annular dressers, is also preferred.

The dressers preferred for the simultaneous dressing of two polishing pads are respectively equipped on their upper side and their underside with at least one dressing element.

In a further embodiment, in a way corresponding to a carrier plate for the polishing of wafers of semiconductor material simultaneously on both sides, these dressers may have clearances into which dressing elements can be placed in a freely movable or fixed manner, so that the at least one dressing element comes into contact on its front side and its rear side with the upper polishing cloth and the lower polishing cloth respectively.

The edge of the dresser preferred for the simultaneous dressing of two polishing pads has peripheral teeth, which ensure the rotational movement of the at least one dresser by the tooth engagement with the inner gear wheel and the outer gear wheel of the device for the simultaneous dressing of two polishing pads.

The surface of the at least one dressing element is raised with respect to the surface of the dresser, so that the surface of the at least one polishing cloth to be dressed preferably only comes into contact with the surface of the at least one dressing element.

The surface or surfaces coming into contact with the polishing cloth (front side and rear side) of the at least one dressing element is/are preferably covered with diamonds, since diamond has the required hardness for dressing polishing pads.

The front side and the rear side of the dressers are preferably equipped symmetrically, for example circularly, with a number of dressing elements, it being possible for there to be no interspace or in each case a defined interspace between the individual dressing elements. It is likewise preferred that the dressing elements form only part of a circle, i.e. that for example a sector of a circle or a segment of a circle is missing.

If the method according to the invention is used for example for simultaneously dressing two polishing pads, a device for the double-sided polishing of semiconductor wafers for example may be used for example. The polishing pads are then respectively applied to the mutually facing faces of the upper polishing plate and the lower polishing plate. The polishing plates (and consequently the polishing pads) are then rotated at a relative rotational speed in relation to one another. Similarly, the dressers are rotated at a relative rotational speed by the rotation of the inner gear wheel (pin wheel) and outer gear wheel (pin wheel) with which they are in tooth engagement.

In this way, the polishing pads can be dressed better than for example just by means of rotation of the two polishing plates, since an additional movement of the dressing elements located on the dressers along the polishing pads is achieved by the additional rotation of the dressers with the at least one dressing element respectively located on their upper side and the underside. The individual directions of rotation may in this case be chosen initially in the same direction as during the polishing or else in the opposite direction.

For example, for this purpose both the polishing plates and the pin wheels may be respectively turned in the same direction of rotation, but with a different absolute rotational speed in each case. In particular, however, opposite directions of rotation respectively both for the polishing plates and also for the pin wheels are expedient. What is decisive here is the additional movement of the dressers in each case.

Preferably, the directions of rotation of at least one of the two pairs of polishing plates and pin wheels are reversed at least once during the dressing. A combination of rotations of the two pairs of polishing plates and pin wheels is referred to as kinematics. By contrast with so-called simple kinematics with only one such combination, an additional combination allows not only the removal of disadvantageous directionally dependent short asperities on the polishing pads, the directional dependence arising during the polishing, but also the creation of additional directionally independent asperities that are advantageous for transporting the polishing agent.

Advantageously, the directions of rotation of only one of the two pairs of polishing plates and pin wheels are reversed at the same time during the dressing. In this way, more combinations can be created than in the case of simultaneous reversal of the directions of rotation of both pairs of polishing plates and pin wheels.

The inventor has discovered that it is particularly advantageous when dressing polishing pads if at least two, particularly at least three, more particularly four, different combinations of directions of rotation of the two pairs of polishing plates and pin wheels or of the polishing cloth and at least one dresser are executed during the dressing (multidirectional dressing).

In the simultaneous dressing of two polishing pads, a total of four different combinations can be created by reversing the directions of rotation in each case of only one of the two pairs of polishing plates and pin wheels. These altogether four possible combinations of directions of rotation relate here to a direction of the asperities present on the polishing pads attributable to the polishing of semiconductor wafers for example.

It has been found that, by executing various combinations, with in particular only the directions of rotation of one of the two pairs of polishing plates and pin wheels being changed respectively from one combination to the next, a particularly long-lasting and significantly stronger effect is obtained than in the case of previously used methods for dressing polishing pads. The previously used methods would sometimes have to be used five to six times in succession to achieve such effects. It should particularly be mentioned once again here that the method according to the invention causes the creation of new, directionally independent asperities on the polishing pads, which are responsible for transporting polishing agents to the semiconductor wafers to be polished, and in particular also for achieving semiconductor wafers that are as plane-parallel as possible. In tests, multidirectional dressing with all four possible combinations has proven to be particularly successful.

Furthermore, it has been found that the method according to the invention for dressing polishing pads has the effect of significantly improving not only the plane-parallelism of the semiconductor wafers, but also the quality of the surface (so-called haze) of the semiconductor wafers. Similarly, with the method according to the invention, a lasting increase in the removal rate during the polishing can be achieved. However, the method has no appreciable influence on a service life of the polishing pads.

The method according to the invention may preferably be used for dressing foamed polishing pads, in particular of polyurethane, since such polishing pads have to be dressed more frequently than other polishing pads. The method according to the invention, in particular the multidirectional dressing, allows a longer-lasting effect to be achieved with respect to the desired polishing quality than with previously known methods. Accordingly, foamed polishing pads also no longer have to be dressed as often.

In the case of the method according to the invention for dressing polishing pads, during the simultaneous dressing of two polishing pads the mutually facing faces of the upper polishing plate and the lower polishing plate are preferably set plane-parallel to one another, in particular also by corresponding corrections of the polishing plates during the dressing, for example by exerting corresponding forces on the upper polishing plate. This helps to achieve the most uniform possible dressing of the polishing pads.

Advantageously, a dressing agent, in particular a liquid, is applied to the polishing pads during the dressing. In this way, contaminants in the polishing pads that occur during the polishing of semiconductor wafers in the form of material removed and are deposited in the polishing pads can be washed out. This also enhances the effect of the dressing in the sense of a regeneration of the polishing pads. The use of water as a dressing agent is particularly expedient, since the components, materials and other tools that are used usually react sensitively to chemically reactive agents.

It goes without saying that the features mentioned above and still to be explained below can be used not only in the respectively specified combination, but also in other combinations or on their own without departing from the scope of the present invention.

The invention is schematically represented on the basis of an exemplary embodiment of the simultaneous dressing of two polishing pads in a first drawing and described in detail below with reference to this drawing and also a second drawing. A third drawing shows an exemplary embodiment of the dressing of a polishing cloth.

FIG. 1 schematically shows in cross section a device that can be used for carrying out the method according to the invention in a preferred embodiment.

In FIG. 1, dressers (4), which can be moved by means of an inner gear wheel (31) and an outer gear wheel (32), a so-called rolling device, are schematically represented. The dressers (4) are equipped with dressing elements (8). On the lower polishing plate (21) there is a polishing cloth (11). On the upper polishing plate (22) there is a polishing cloth (12). The upper polishing plate (22) is pressed with the polishing cloth (12) in the direction of the polishing or pressing pressure (7) against the dressers (4), and consequently against the dressing elements (8) and also the lower polishing plate (21) with the polishing cloth (11). For the sake of completeness, it should also be mentioned at this point that the mutually facing faces of the polishing plates (21, 22) are annular.

Furthermore, the directions of rotation of the polishing plates and the pin wheels about a common axis of rotation are represented in FIG. 1. In this case, (ω22), (ω31), (ω32) and (ω21) denote the directions of rotation of the upper polishing plate (22), the inner pin wheel (31), the outer gear wheel (32) and the lower polishing plate (21), respectively, in the sequence given.

Figure 2:
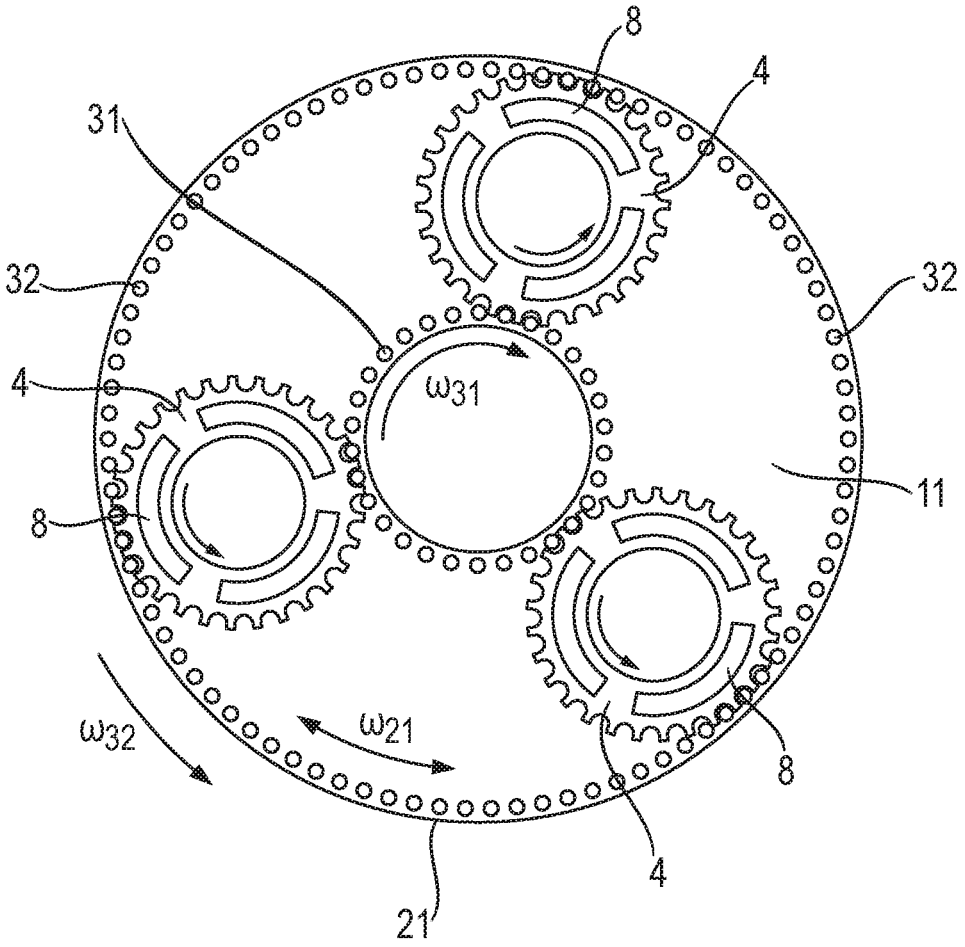
FIG. 2 shows schematically, in plan view, an arrangement of a device, useful for carrying out a method according to the invention.

FIG. 2 schematically shows in plan view an arrangement of three dressers (4) on the lower polishing plate (21), which is covered with a polishing cloth (11), which can be used for carrying out the method according to the invention in a preferred embodiment. The dressers (4) are moved in a circular manner by means of an inner gear wheel (31) and an outer gear wheel (32), the so-called rolling device. The dressers (4) are represented here as annular, with dressing elements (8) provided on them, without the invention being restricted to this embodiment. Neither the dressing elements directed toward the lower polishing cloth (11) nor the upper polishing plate (22) are depicted for reasons of overall clarity.

Figure 3:
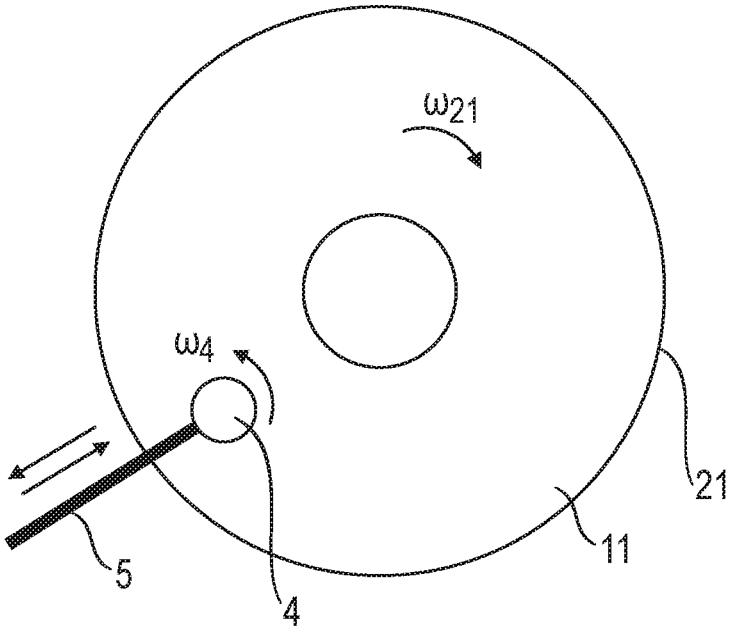
FIG. 3 shows an exemplary embodiment of the dressing of a polishing cloth.

FIG. 3 schematically shows in plan view a possible embodiment for the dressing according to the invention of a polishing cloth (11), which covers a polishing plate (21). The at least one dresser (4) can be moved back and forth from the edge of the cloth to the center of the cloth during the dressing by means of an arm (5), and at the same time rotate. The polishing plate (21) covered with the polishing cloth (11) can likewise be rotated. In FIG. 3, one possible combination of the directions of rotation of the polishing plate (21) and the at least one dresser (4) is represented by way of example. In this case, (ω21) and (ω4) denote the directions of rotation of the polishing plate (21) and of the dresser (4). For reasons of overall clarity, no dressing elements that are directed toward the polishing cloth (11) are depicted in the case of the dresser (4), represented by way of example as circular.

As already stated, the method according to the invention may be carried out both with a device for the one-sided polishing and a with device for the double-sided polishing of semiconductor wafers. If a device for the double-sided polishing of semiconductor wafers is used, the dressers (4) may be used instead of the carrier plates used in the polishing process.

When a device for the double-sided polishing of semiconductor wafers is used, it is preferred to use annular or disk-shaped dressers (4) with a peripheral ring of teeth, which is in tooth engagement with the inner gear wheel (31) and the outer gear wheel (32). The rotational movements of the dresser (4) that are necessary for the multidirectional dressing are ensured by the rotation of the two pin wheels. The side of the dresser (4) facing the upper polishing cloth (12) and the side of the dresser (4) facing the lower polishing cloth (11) are preferably equipped in each case with at least one dressing element (8).

In a further embodiment of the simultaneous dressing of two polishing pads by the method according to the invention, the at least one dresser (4) has one or more clearances analogous to carrier plates such as are used in the double-sided polishing of semiconductor wafers. The dressing elements (8) necessary for carrying out the method according to the invention are inserted into this at least one clearance. In this embodiment, the dressing elements (8) are preferably freely movable or can rotate freely in the clearance. Likewise preferably, the dressing elements (8) are fixed in the clearance. The at least one dressing element (8) placed into a clearance of a dresser (4) is preferably covered with diamonds on both sides coming into contact with the lower polishing cloth (11) and the upper polishing cloth (12). In addition, the dresser (4) designed like a carrier plate may be additionally equipped with at least one dressing element (8) respectively on the side facing the upper polishing cloth (12) and the side facing the lower polishing cloth (11).

By way of example, in FIG. 1 the directions of rotation (ω22) and (ω32) of the upper polishing plate (22) and of the outer gear wheel (32) are shown as clockwise, the directions of rotation (ω31) and (ω21) of the inner gear wheel (31) and of the lower polishing plate (21) are shown as counterclockwise, which represents one possible combination of four different combinations of directions of rotation. It has been taken into account here that, according to the invention, the polishing plates (21, 22) and the gear wheels (31, 32) respectively rotate with a rotational speed relative to one another, in that they rotate in opposite directions.

The combination shown can then serve for example as a first combination to be set when carrying out a method according to the invention. The further combinations to be successively set are then obtained for example by first the directions of rotation (ω21, ω12) of the polishing plates (21, 22) and later the directions of rotation (ω31, ω32) of the gear wheels (31, 32) being reversed. Finally, the directions of rotation (ω21, ω12) of the polishing plates (21, 22) may subsequently be reversed once again. Altogether, four different combinations of the directions of rotation are obtained in the sense of multidirectional dressing, with only the directions of rotation of one pair of polishing plates (21, 22) or gear wheels (31, 32) being reversed respectively in each step. However, a different sequence of the combinations is also conceivable. These altogether four possible combinations of directions of rotation relate here to a direction of the asperities present on the polishing pads attributable to the polishing (directionally dependent asperities).

The combinations of the multidirectional dressing that are described here may of course likewise be used correspondingly for the dressing of only one polishing cloth. When a device for the one-sided polishing of semiconductor wafers is used, it is preferred to use annular or disk-shaped dressers (4). The at least one dresser (4) is pressed against the polishing cloth to be dressed by a suitable device, for example a movable arm as represented in FIG. 3, and can be rotated in various directions (clockwise or counterclockwise).

By way of example, in FIG. 3 the direction of rotation (ω21) of the polishing plate (21) is shown as clockwise and the direction of rotation (ω4) of the dresser (4) is shown as counterclockwise, which represents one possible combination of four different combinations of directions of rotation. It has been taken into account here that, according to the invention, the polishing plate (21) and the at least one dresser (4) respectively rotate with a rotational speed relative to one another.

The exact sequence when changing the directions of rotation during the dressing may in this case be adapted to the previously used kinematics during the polishing. Therefore, different sequences of the combinations that lead to the best result may arise according to the application. Similarly, the time for which the individual combinations remain set may be adapted according to the application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A method for conducting a multidirectional dressing process on a polishing cloth, the polishing cloth being applied to a polishing, the method for conducting the dressing process on the polishing cloth comprising:

disposing at least one pin wheel at a periphery of the polishing plate to allow different relative rotation directions of the dresser and polishing plate;

arranging at least one dresser, including a dressing element disposed on a first side of the at least one dresser, such that the polishing cloth is in a state where the polishing cloth is in contact with the dressing element, the polishing cloth being between the polishing plate and the first side of the dresser;

in the state where the polishing cloth is in contact with the dressing element, performing a multi-phased dressing operation creating directionally independent asperities on the polishing cloth, the multi-phased dressing operations comprising:

in a first phase:

rotating the polishing plate in a first direction with a first relative rotational speed, the rotating of the polishing plate resulting in a rotation of the polishing cloth in the first direction with the first relative rotational speed; and rotating the at least one dresser in a second direction with a second relative rotational speed, wherein the second direction is opposite the first direction and where the second relative rotational speed differs from the first relative rotational speed so as to dress the polishing cloth in the first phase; and in a second phase of the multidirectional dressing process, after the first phase:

rotating the polishing plate in the second direction, which reverses the rotation of the polishing cloth to also be in the second direction;

and rotating the at least one dresser in the first direction so as to dress the polishing cloth in the second phase creating directionally independent asperities.

2. The method of claim 1, further comprising:

rotating the dresser using a rolling device including an inner gear wheel and an outer gear wheel.

3. The method of claim 2, further comprising:

setting mutually facing faces of an upper polishing plate and a lower polishing plate plane-parallel to one another.

4. The method of claim 2, wherein the dresser has a clearance, and the dressing element is freely movable or fixed in the clearance.

5. The method of claim 1, wherein disks or rings covered with one or more dressing elements, comprising the dressing element, are used as the dresser.

6. The method of claim 1, wherein the dressing element includes a surface covered with diamonds.

7. The method of claim 1, wherein the at least one dresser is one of one to five dressers that are used simultaneously.

8. The method of claim 1, wherein the at least one dresser is one of at least three dressers that are used simultaneously.

9. The method of claim 1, wherein the polishing cloth is a foamed polishing pad.

10. The method of claim 9, wherein the foamed polishing pad is a foamed polyurethane.

11. The method of claim 1, further comprising:

applying a dressing agent to the polishing cloth.

12. The method of claim 1, further comprising:

applying a liquid dressing agent to the polishing cloth.

13. The method of claim 1, wherein a second polishing cloth is applied to a second polishing plate, wherein a second dressing element is on a second side of the dresser, the method further comprising:

contacting the second polishing cloth with the second dressing element, the second polishing cloth being disposed between the second polishing plate and the second side of the dresser; and in a state where the second polishing cloth is in contact with the second dressing element, rotating the second polishing plate simultaneously with the polishing plate in the first direction with the first relative speed.

14. The method of claim 1, wherein the method is performed by a polishing device that is configured to polish the semiconductor wafer, the polishing device comprising the polishing plate and configured to receive the dresser and the pin wheel, and wherein the method further comprises:

prior to polishing the semiconductor wafer, removing the pin wheel and disposing the semiconductor wafer in the polishing device.

15. The method of claim 14, the method further comprising, prior to disposing the semiconductor wafer in the polishing device, disposing a carrier plate in the polishing device, wherein the semiconductor wafer is disposed in the carrier plate.

16. The method of claim 14, of the method comprising removing the dresser after performing a plurality of dressing operations creating the directionally independent asperities on the polishing cloth.

17. The method according to claim 1, wherein the plurality of multi-phased dressing operation further comprises a third phase, during which the direction of rotation is reversed for at least one of the polishing plate or the at least one dresser while the polishing cloth maintains the state of contact with the at least one dresser.

18. The method according to claim 17, wherein the first direction is a clockwise direction and the second direction is a counter clockwise direction, wherein the multi-phased dressing operation further comprises a fourth phase, during which the direction of rotation is reversed for at least one of the polishing plate or the at least one dresser while the polishing cloth maintains the state of contact with the at least one dresser, and wherein upon completing all of the first phase, the second phase, the third phase, and the fourth phase, each of the following combinations of directions of rotation of the polishing plate and the at least one dresser have been performed:

the polishing plate and the at least one dresser rotating in the clockwise direction;

the polishing plate and the at least one dresser rotating in the counter clockwise direction;

the polishing plate rotating in the clockwise direction and the at least one dresser rotating the counter clockwise direction; and the polishing plate rotating in the counter clockwise direction and the at least one dressing rotating in the clockwise direction.

* * * * *